US010849395B2

(12) United States Patent
Aubin et al.

(10) Patent No.: US 10,849,395 B2
(45) Date of Patent: Dec. 1, 2020

(54) SYSTEMS, METHODS, AND DEVICES FOR SENSING AND PROVIDING BIOFEEDBACK AT TARGET AXIAL LOAD

(71) Applicants: University of Washington, Seattle, WA (US); The United States as represented by the Department of Veterans Affairs, Washington, DC (US)

(72) Inventors: Patrick M. Aubin, Seattle, WA (US); Chris Richburg, Seattle, WA (US); Joseph Czerniecki, Seattle, WA (US); Evan Schuster, Seattle, WA (US)

(73) Assignees: University of Washington, Seattle, WA (US); The United States as represented by the Department of Veteran Affairs, Washington, DC (US)

( * ) Notice: Subject to any disclaimer, the term of this patent is extended or adjusted under 35 U.S.C. 154(b) by 0 days.

(21) Appl. No.: 15/958,947

(22) Filed: Apr. 20, 2018

(65) Prior Publication Data

US 2018/0332933 A1 Nov. 22, 2018

Related U.S. Application Data

(60) Provisional application No. 62/488,384, filed on Apr. 21, 2017.

(51) Int. Cl.

| | |
|---|---|
| ***A45B 9/04*** | (2006.01) |
| ***A61H 3/02*** | (2006.01) |
| ***A45B 3/00*** | (2006.01) |

(52) U.S. Cl.

CPC ..... *A45B 9/04* (2013.01); *A45B 3/00* (2013.01); *A61H 3/02* (2013.01); *A61H 3/0288* (2013.01);

(Continued)

(58) Field of Classification Search

CPC ..... A45B 9/04; A61H 3/0288

See application file for complete search history.

(56) References Cited

U.S. PATENT DOCUMENTS 5,511,571 A 4/1996 Adrezin
5,727,584 A * 3/1998 Stanec ..... A45B 9/04 135/65

(Continued)

FOREIGN PATENT DOCUMENTS

DE 19915603 C1 10/2000
DE 10160537 A1 6/2003

(Continued)

OTHER PUBLICATIONS

Moran, et al., "A Biofeedback Cane System: Instrumentation and Subject Application Results", IEEE Transactions on Rehabilitation Engineering, 3(1):132-138 (1995).

(Continued)

*Primary Examiner* — Noah Chandler Hawk

(74) *Attorney, Agent, or Firm* — McDonnell Boehnen Hulbert & Berghoff LLP

(57) ABSTRACT

Several embodiments are provided of a device which is tunable for providing a walking aid user with passive haptic feedback. The haptic feedback is provided to the user when a predetermined, desired force in the device is reached. The force, often simply an axial force, in the device is inputted by the user, who is looking to support some of his or her body weight, thereby taking some weight off of one or both legs for some purpose. The amount of body weight support the user would input is often expressed in terms of percentage of the user's total body weight, and can therefore be predetermined and the device tuned accordingly.

13 Claims, 13 Drawing Sheets

(52) U.S. Cl.
CPC .. *A45B 2200/05* (2013.01); *A61H 2201/0184* (2013.01); *A61H 2201/1207* (2013.01); *A61H 2201/1246* (2013.01); *A61H 2201/1657* (2013.01); *A61H 2201/5061* (2013.01); *A61H 2201/5071* (2013.01)

(56) References Cited

U.S. PATENT DOCUMENTS

| | | | | |
|---|---|---|---|---|
| 5,775,352 | A | 7/1998 | Obitts | |
| 6,011,481 | A | 1/2000 | Luther | |
| 7,385,514 | B2 | 6/2008 | Dempsey | |
| 7,493,810 | B2 * | 2/2009 | Walczyk | G01L 1/04 200/1 B |
| 7,918,237 | B1 * | 4/2011 | Kuo | A61H 3/02 135/65 |
| 9,131,754 | B2 * | 9/2015 | Basham | A45B 9/00 |
| 9,763,848 | B1 | 9/2017 | Handzic | |
| 9,826,806 | B2 * | 11/2017 | Challa | A45B 9/04 |
| 2005/0129456 | A1 * | 6/2005 | Van Der Sluis | A61H 3/0277 403/109.1 |
| 2011/0209733 | A1 * | 9/2011 | Basham | A45B 3/00 135/82 |
| 2011/0240077 | A1 * | 10/2011 | Doherty | A61H 3/02 135/71 |
| 2013/0098412 | A1 | 4/2013 | Weber | |
| 2013/0144197 | A1 | 6/2013 | Ingimundarson | |
| 2013/0218053 | A1 | 8/2013 | Kaiser | |
| 2013/0346021 | A1 | 12/2013 | Stevens | |
| 2017/0156458 | A1 | 6/2017 | Hayden | |
| 2017/0224574 | A1 | 8/2017 | Hayden | |
| 2019/0104814 | A1 * | 4/2019 | Bullard | A45B 9/00 |

FOREIGN PATENT DOCUMENTS

| | | | | |
|---|---|---|---|---|
| DE | 202005000466 | U1 | 5/2005 | |
| DE | 202006009982 | U1 | 1/2007 | |
| DE | 102008059776 | A1 | 8/2009 | |
| DE | 102009057424 | B4 * | 9/2012 | A61H 3/02 |
| DE | 102005014661 | B4 * | 5/2013 | A61H 3/0277 |
| DE | 202007016709 | | 10/2018 | |
| EP | 1040811 | A2 | 10/2000 | |
| EP | 1519701 | A1 | 4/2005 | |
| JP | 2003153715 | A | 5/2003 | |
| WO | 2007137851 | A2 | 12/2007 | |
| WO | 2012093181 | A1 | 7/2012 | |

OTHER PUBLICATIONS

Mercado, et al., "Smart cane: Instrumentation of a quad cane with audio-feedback monitoring system for partial weight-bearing support" University of Santo Tomas, Manila, Philippines (2014).

Routson, et al., "A Smart Cane with Vibrotactile Biofeedback Improves Cane Loading for People with Knee Osteoarthritis", IEEE, pp. 3370-3373.

* cited by examiner

SYSTEMS, METHODS, AND DEVICES FOR SENSING AND PROVIDING BIOFEEDBACK AT TARGET AXIAL LOAD

CROSS-REFERENCE TO RELATED APPLICATIONS

This application claims the benefit of the filing date of U.S. Provisional Patent Application Ser. No. 62/488,384, filed Apr. 21, 2017, which is hereby incorporated by reference in its entirety.

FEDERALLY SPONSORED RESEARCH

This invention was made with government support under RX001926 awarded by the Department of Veterans Affairs. The government has certain rights in the invention.

BACKGROUND

Unless otherwise indicated herein, the materials described in this section are not prior art to the claims in this application and are not admitted to be prior art by inclusion in this section.

The prescription of a cane is a common treatment method for patients with knee osteoarthritis. Cane use can reduce medial knee load during gait and, when used in the contralateral hand, has been shown to reduce Knee Adduction Moment (KAM) by an average of 10%, with a quarter of subjects decreasing KAM up to 20%. In addition, a recent study showed a direct dose-response effect between cane loading and KAM; as cane loading increased to 20% body weight (BW) the KAM decreased. This study confirmed that reduced knee loading is only achieved when sufficient BW loading of the cane occurs. With proper loading, cane use has been shown to reduce knee pain and improve function in osteoarthritis patients, but the majority of cane users do not receive instruction on how to most effectively use a cane to unload their knee joint.

A recent study found that a majority of cane users in a senior living community self-prescribe their canes and most receive no education or demonstration from medical professionals as to its proper use. Proper cane use is unintuitive and users sometimes fail to even use the cane in the proper contralateral hand without instruction.

Even with instruction, consistently loading a cane with sufficient BW over the long-term can be challenging. Some patients use knee pain to guide how much cane force to apply. However, pain is subjective and may not correlate with joint loading, hence pain is an undesirable feedback signal to guide proper cane loading. A simple and intuitive over-the-counter solution facilitating proper long-term cane use and loading is needed.

BRIEF SUMMARY

A device for providing feedback comprising a mechanism providing discrete feedback at a specified load. The mechanism is tunable to provide feedback at the specified load.

DETAILED DESCRIPTION

Example devices, methods, and systems are described herein. It should be understood that the words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood aspects of the present disclosure, as generally described herein, and illustrated in the figures, can be arranged, substituted, combined, separated, and designed in a wide variety of different configurations, all of which are explicitly contemplated herein.

Furthermore, the particular arrangements shown in the Figures should not be viewed as limiting. It should be understood other embodiments may include more or less of each element shown in a given Figure. Further, some of the illustrated elements may be combined or omitted. Yet further, an example embodiment may include elements not illustrated in the Figures. As used herein, with respect to measurements, "about" means +/−5%.

Figure 1:
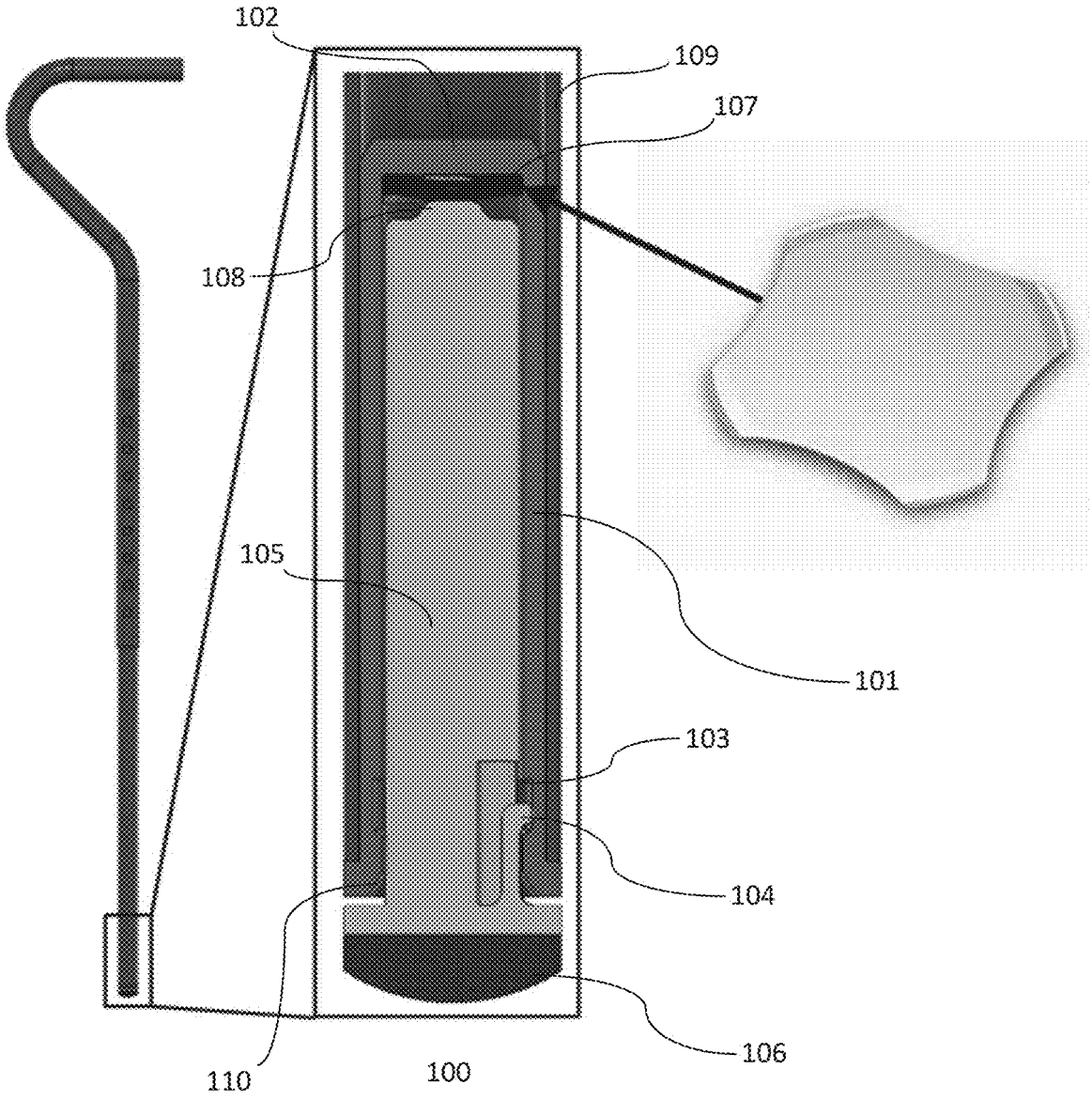
FIG. 1—Cross-section of a passive device as used in a hollow cane shaft in accordance with an embodiment.

The present disclosure provides various devices for measuring load, of pressure applied, such as axial load in a walking aid and providing feedback to a user when a load corresponds to a predetermined desired force input by the user is measured. A walking aid may be a cane, a walker, a crutch, a pair of crutches, a forearm crutch, or a pair of forearm crutches. In particular, with reference to FIG. 1 illustrating a passive mechanical clicker or elemental feedback device 100 according to an example embodiment. In particular, FIG. 1 illustrates a longitudinal cross-section view of an example device 100 as it would interface with the hollow shaft at the foot of a walking aid 109. As shown in FIG. 1, the device 100 may include a cylindrical tube 101 or column or another three dimensional shape which is closed or sealed at one end, 102 or 110, and openable at one end, 102 or 110, to allow access to it's the inner surface of the cylindrical tube 101 or another three dimensional shape. Alternatively, both ends are sealed and the hollow portion of the cylindrical tube is accessed via sliding of two co-axial cylinders or columns where at least the larger diameter column is hollow to receive the smaller diameter column, which can be solid or hollow with a predetermined wall thickness. In another example, the shaft of the column could open midpoint or along the shaft to allow access to the inner, hollow part of the cylinder or column of the device 100. Other embodiments are possible. In one example, the cylindrical tube 101 wall, nearer to the open end 110, has at least one portion of the tube wall where the inner wall surface features an indent 103. The indent 103 creates a receiving area for a tab with a protrusion 104 to prevent the device's footpiece 105 from sliding out by engaging with the edge of the indent 103 nearest to the open end of the cylindrical tube. In a further example, while the expanded view in FIG. 1 illustrates the upper portion of the device 100 to be one end 102 and the lower, bottom portion to comprise one end 110, a reversed arrangement is also possible with the ground engaging attachment 106 affixable to the lower or bottom end, whether 102 or 110. Other embodiments and configurations are possible as would be apparent to one skilled in the art.

In several embodiments, the device provides feedback when a user partially supports their body weight with the walking aid 109. The device's footpiece 105 or a coupled ground engaging attachment 106 contacts a walking surface and the user begins to apply an axial load into the walking aid 109. When a predetermined desired force is inputted by the user into the walking aid 109, the ground engaging attachment 106 remains firmly in place, and the footpiece 105 depresses one or more, or a series of snap domes 107 via the footpiece's top tip 108. The snap domes 107, upon reaching the predetermined desired force, suddenly elastically deform to a position where the topmost snap dome in the series 107 is in firm contact with the flat, closed end 102 of the cylindrical tube 101. When the axial load is removed, and the device returns to an unloaded position (as in 100), ready for the next loading cycle. The sudden deformation of the snap domes is easily sensed by the user of the walking aid as a "snap" or "pop" which the user can feel, and possibly hear, and occurs when the user inputs an axial load sufficient to overcome the amount of force which the series of snap domes is set to elastically deform, and may also be referred to as "tripping" the device. When snap domes, the cylindrical tube 101, and the footpiece 105 are engaged with each other, they form an embodiment of the passive feedback device.

Figure 2:
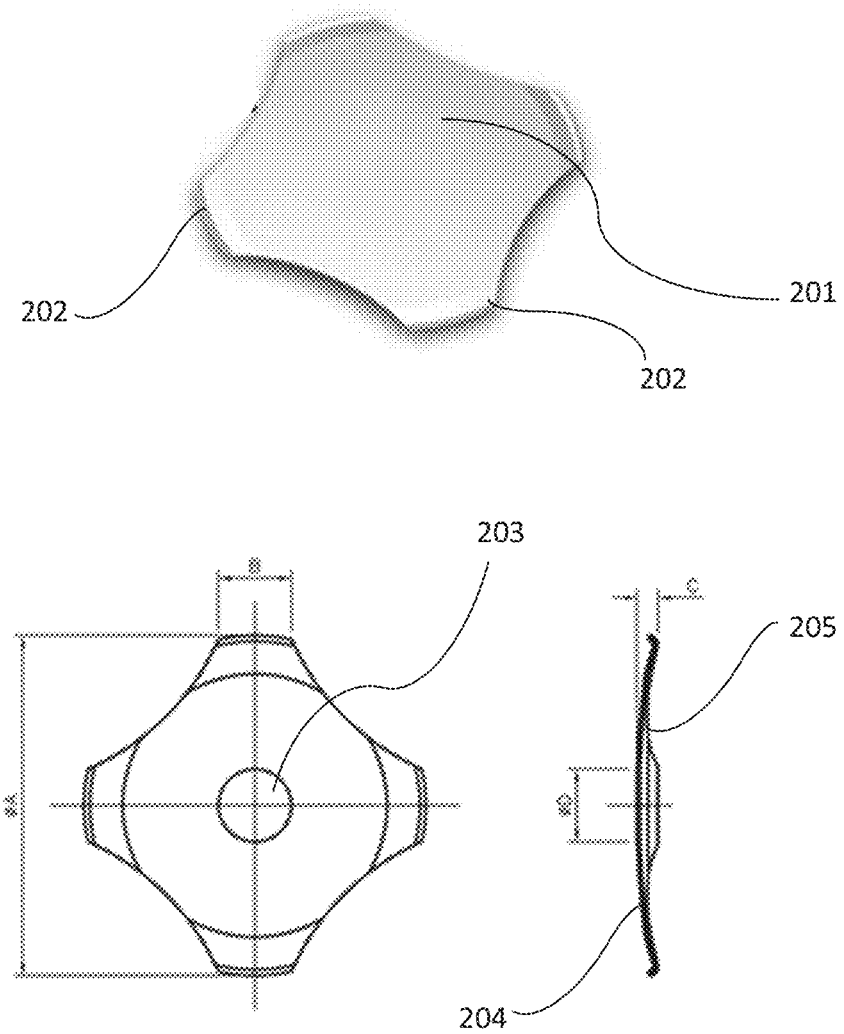
FIG. 2—Snap domes, which are used as a haptic feedback element of the device as shown in FIG. 1, and in several other embodiments of feedback devices.
Figure 3A:
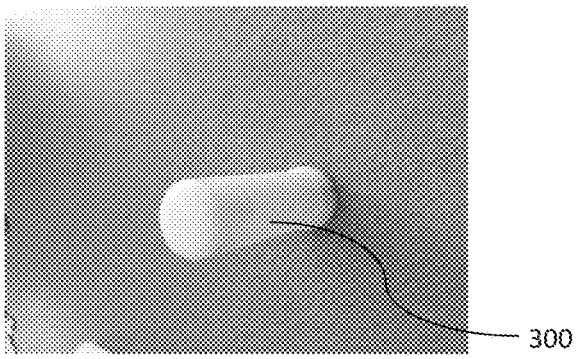
FIGS. 3 A-F—Several views of an embodiment of the feedback device.
Figure 3B:
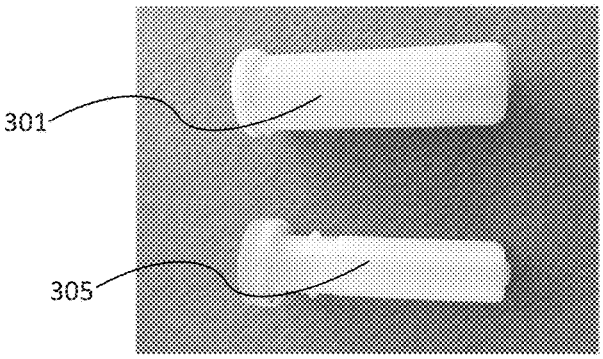
Figure 3C:
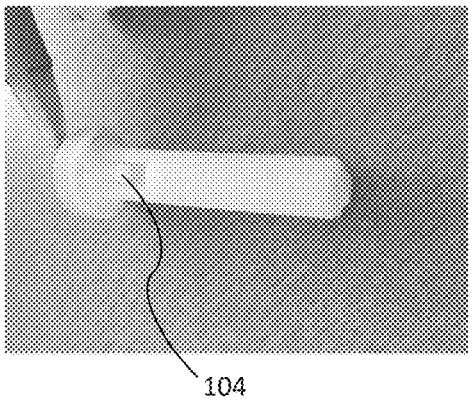
Figure 3D:
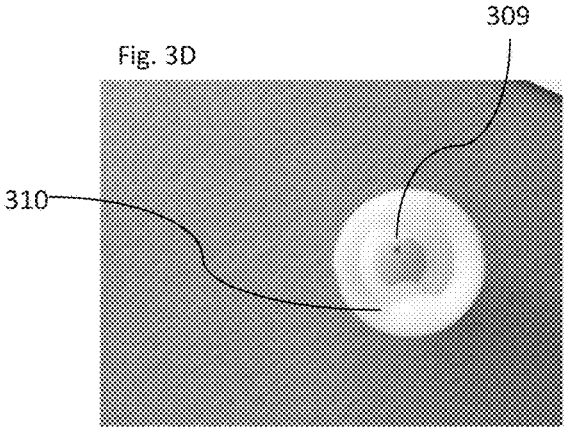
Figure 3E:
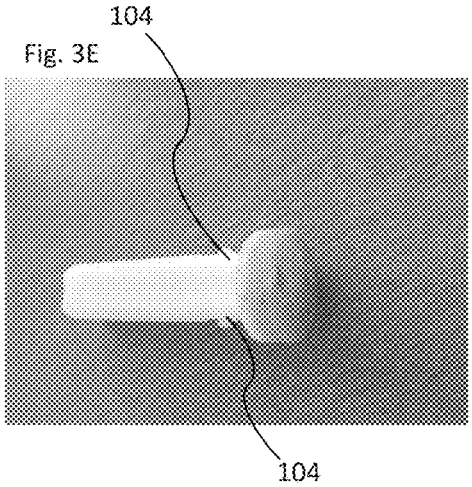
Figure 3F:
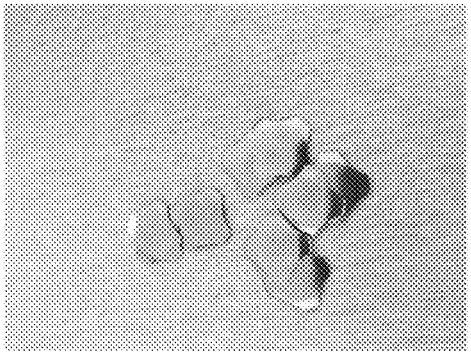
Figure 7:
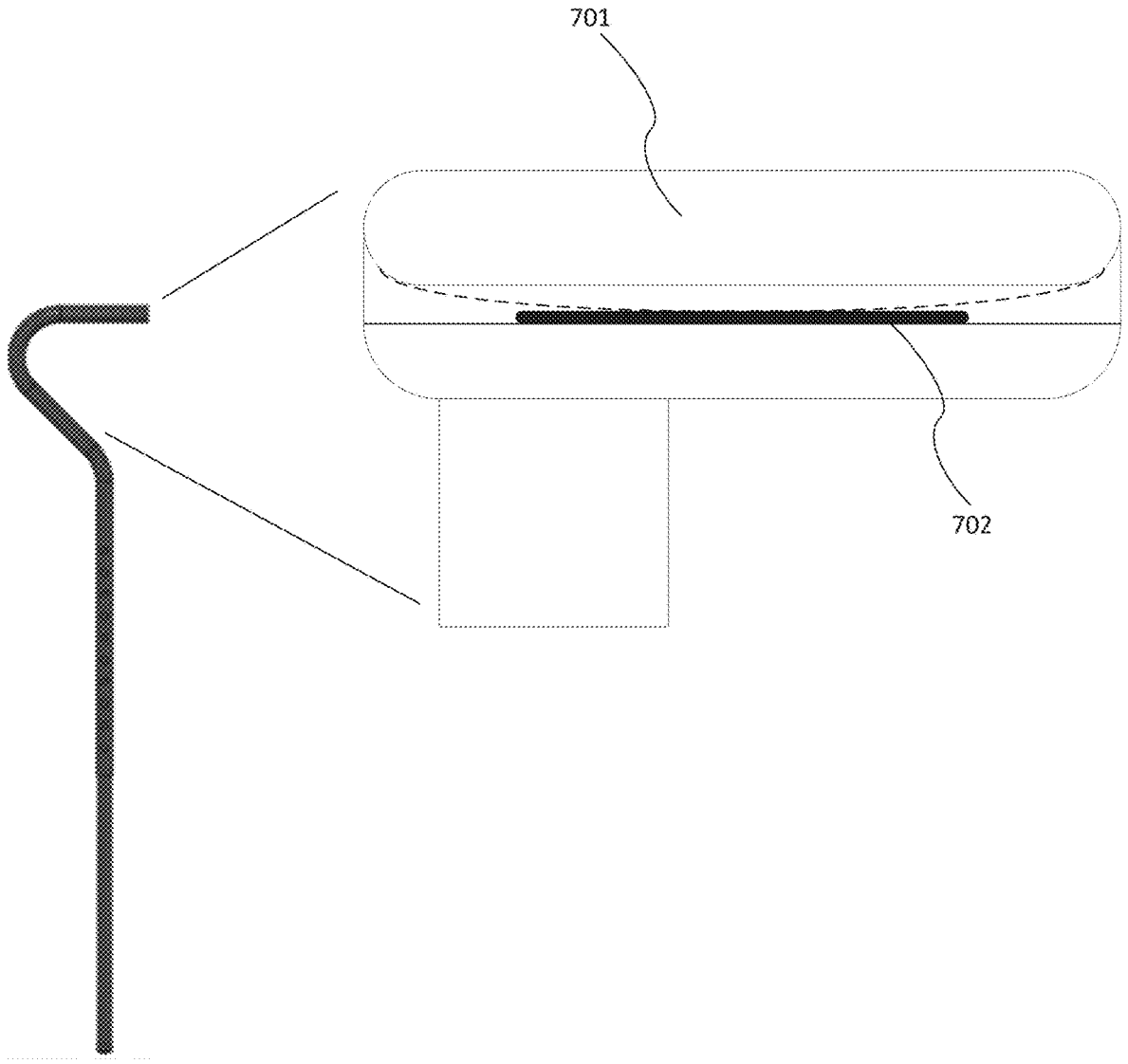
FIG. 7—A feedback device embodiment using a pressure pad located in a cane handle.

FIG. 2 illustrates an example of a snap dome 201. Other types and shapes of snap domes are possible, for example circular, oval, triangular, semispherical, etc. A snap dome 201 is a leaf spring in a disk-shaped arrangement designed to provide discrete feedback to a user interacting with the snap dome through touching and applying pressure or force of $F_{max}$ at which point the snap dome trips, the user experiences a "snap," which can be any combination of audible, tactile, and haptic feedback. The snap dome 201 as shown in FIG. 2, or 107 as shown in FIG. 1, rests on support points 202 on a flat surface, and engagement of force to the snap dome 201 occurs primarily in the center of the top of the dome 203, with force applied to the snap dome including a component directly orthogonal to the flat planar surface the support points 202 of the dome rest on. Snap dome 201 dimensions may be specified and customized to create a predetermined, desired force to trip the snap dome. Snap dome shape configurations can also be customized, as the embodiment in FIG. 7 shows.

A snap dome 201 has a short displacement distance when properly supported and tripped, resulting in a short distance travelled by the user's hand/arm when tripping the snap domes. Additionally the snap domes, even when placed in a series to elevate the total force required to trip the entire series, displace about the same distance as one snap dome tripping. For a user of a device which provides support to the user and feedback about the user's axial loading of the device, minimal or no axial displacement maintains user comfort.

In several embodiments, snap domes 201 are used to provide user feedback both haptic and/or audible. In situations where the audible feedback is not experienced by the user, the haptic feedback provides feedback to the user about when the predetermined desired force is reached.

In several embodiments of the present disclosure, the feedback device 100 is tunable to different predetermined desired forces by, for example, changing the number, or type, or the number and type of snap domes 201 used to tune the feedback to the predetermined desired force. The predetermined desired force may be determined, for example, when the feedback device is being used in a walking aid, or in other ways in other applications, such as by setting the predetermined desired force as a function of a designed safe loading upper limit. Snap domes 201 can be placed one on top of the other, where the convex side 204 of one is nestled into the concave side 205 of the next, creating a series of snap domes. In several embodiments, interaction of a series of snap domes is additive—the $F_{max}$ of each of the snap domes can be simply added together to provide the series $F_{max}$. For example, if a predetermined desired force for a user of a walking aid is 15% of the user's body weight of 100 pounds, the 15 pounds of snap dome series $F_{max}$ can be achieved by using 15 snap domes, each with an $F_{max}$ of one pound. The snap dome series could also be made of 6 snap domes, each with an $F_{max}$ of 2.5 pounds. The snap domes series could also be made of 4 snap domes, each with an $F_{max}$ of 2.5 pounds, and 5 more snap domes, each with an $F_{max}$ of one pound. A user could hear and/or feel one distinctive "snap" when the feedback device is subjected to the predetermined desired force. The possible combinations are too extensive to list, as the examples given here are intended to illustrate.

When tuning the predetermined desired force, which may also be referred to as the ideal force, at which the device trips, the addition or subtraction of snap domes 201 from the series placed in the cylindrical tube 101 may result in a small change in the height of the series of snap domes 107. In a further embodiment, using a blank disk to compensate for the thickness of a removed snap dome can maintain the relationship between the cylindrical tube 101 and the footpiece 105 at different predetermined desired forces. In several embodiments of the present disclosure, the height of the series of snap domes, as well as the overall length of the walking aid, can be maintained by using blank disks, even when the predetermined desired force is tuned through adding or removing snap domes. The blank disks have perimeter shapes similar to snap domes 201. The blank disks are flat so they do not produce a snap effect under a load. The blank disks are loaded in the clicker device at the first end 102 of the cylindrical tube, where the closed end is located. The blank disks therefore bear completely with a flat side against the flat, closed end 102 of the tube 101, and provide a flat bearing surface for the series of snap domes 107 stacked against the blank disks.

In several embodiments of the clicker device, a small hole 309 passes through a closed, first end 102 of the tube 101, which may be cylindrical or some other shape. The small hole 309 acts as a vent for air pressure which may build in the small hollow volume extending from the concave side of the snap domes 107. Additionally, the diameter of the small hole 309 is large enough to allow passage of a small tool to be used to push snap domes 107 or blank disks out of the tube 101. The diameter of the small hole 309 may be up to 2 mm, for example.

In several embodiments of the clicker or feedback device 100, the footpiece 105 is capable of receiving different ground-engaging attachments 106. Shown in FIG. 1, is a rounded, durable rubber foot 106 integral to the footpiece 105, suitable for most walking surfaces. Other attachments can be attached or coupled to the footpiece, still allowing for normal functioning of the clicker or feedback device.

FIGS. 3 A-F illustrate, by example, in some embodiments of the device 300, inner walls of the tube 301 have keyways 310 shaped to interface with the perimeter edge of a snap dome 201, to ensure the snap domes 201 do not rotate or turn in the cylindrical tube 301 after being inserted for use. Additionally, with correspondingly-shaped channels along the length of the footpiece 305 keeps the footpiece's 305 movement relative to the tube 301 linear, reducing rotation about the footpiece's 305 longitudinal axis.

Figure 4:
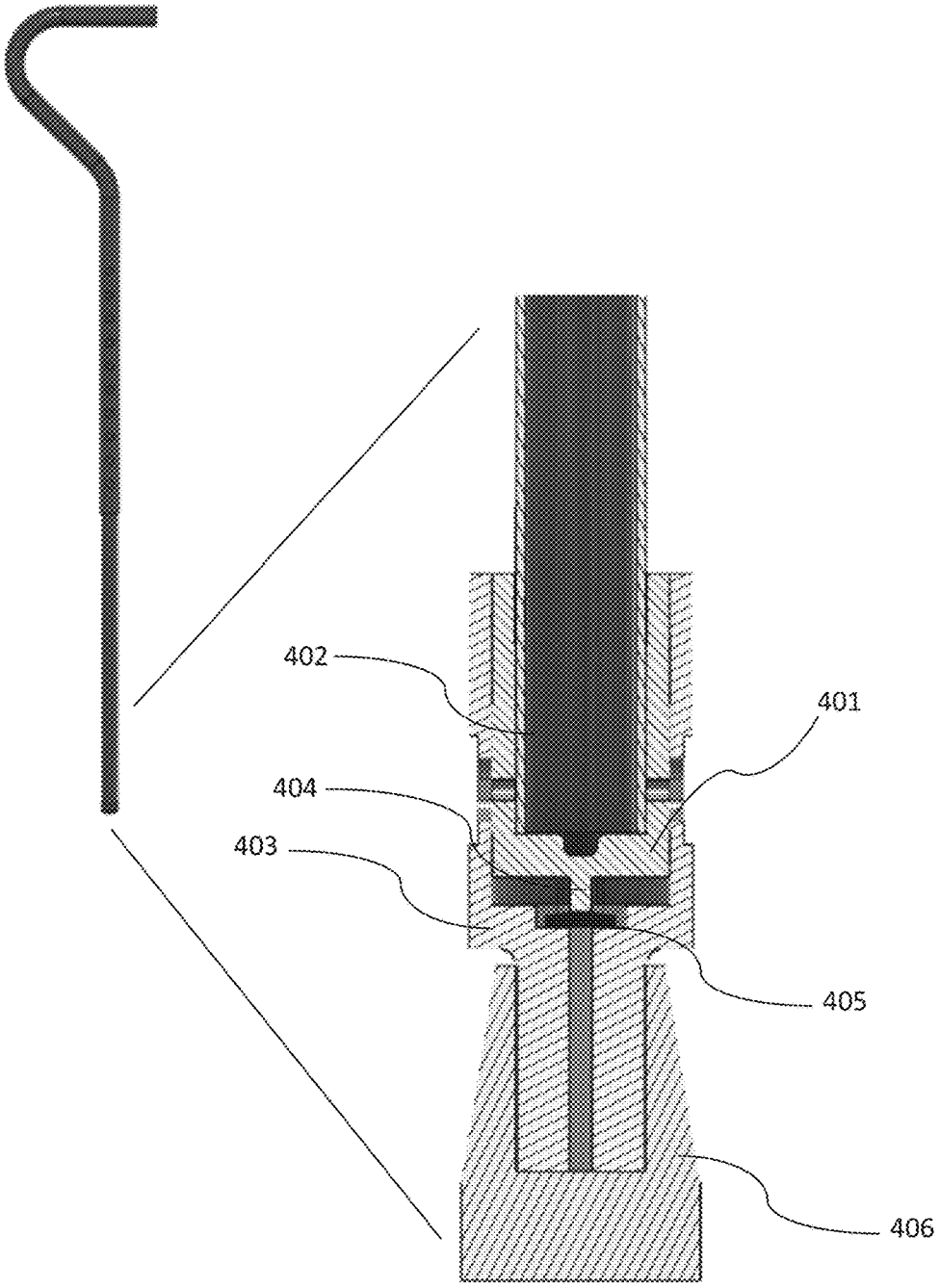
FIG. 4—Illustrating the feedback device mounted externally to a cane shaft, in accordance with an embodiment.

Some embodiments of a feedback device, which can be a passive feedback device, are loaded inside of one or more hollow shaft(s) of a walking aid, as in FIGS. 1 and 3. FIG. 4 shows, by way of one example, some embodiments of a passive feedback device attached to the foot of a walking aid like a sleeve fitting over the end of a solid or hollow cane shaft. In particular, FIG. 4 shows an inner piece 401 interfacing with the bottom end of the walking aid shaft 402. The inner piece may be removably attached to the walking aid shaft 402. A feature of the inner piece 401 is a tip 404 to interact with one or more, or a stack of snap domes 405, and is sized to appropriately contact the center of a snap dome 203. The stack of snap domes 405 rest within an outer piece 403, which is removably attached to the inner piece 401. Finally, a ground engaging attachment 406 may be removably attached to the bottom portion of the outer piece.

In several embodiments of feedback devices providing the user of a walking aid some form of feedback when the user inputs a predetermined desired force into the walking aid, the device may either maintain the overall length of the walking aid while providing feedback or the overall length of the walking aid may be affected minimally. No embodiment presently disclosed changes the overall length of the walking aid more than 25 mm in order to provide feedback to the user of the walking aid. However, should a larger change in length be desirable, it would be easily implemented.

A feedback device, either a passive mechanical device or an active device, may also be used in more static, or longer cycle loading applications. In some embodiments, a feedback device may be coupled to a different host structure to provide "snap" feedback about when the host structure has been subjected to a predetermined desired force. For example, a pallet used to pack and move goods may have a designed safe loading upper limit. Fitting such a pallet's ground engaging feet with passive feedback devices would allow anyone working with the pallet to receive feedback about when the pallet's load has reached the designed safe loading upper limit. Another example of using the feedback device in a different application is fitting a feedback device to a moving dolly. Moving dollies can have different load capacities, and a feedback device may alert a user when the load capacity has been reached. Other products where such feedback device can be implemented would be apparent to one skilled in the art.

Different embodiments of the passive or active feedback devices of the present disclosure provide feedback about loading in a walking aid via haptic feedback, audio feedback, visual feedback, or some combination thereof. Haptic feedback can be generated either passively (by non-electronic components) or actively (by electronic components). Audio feedback also can be generated either passively or actively. Visual feedback can be generated passively or actively.

Figure 5:
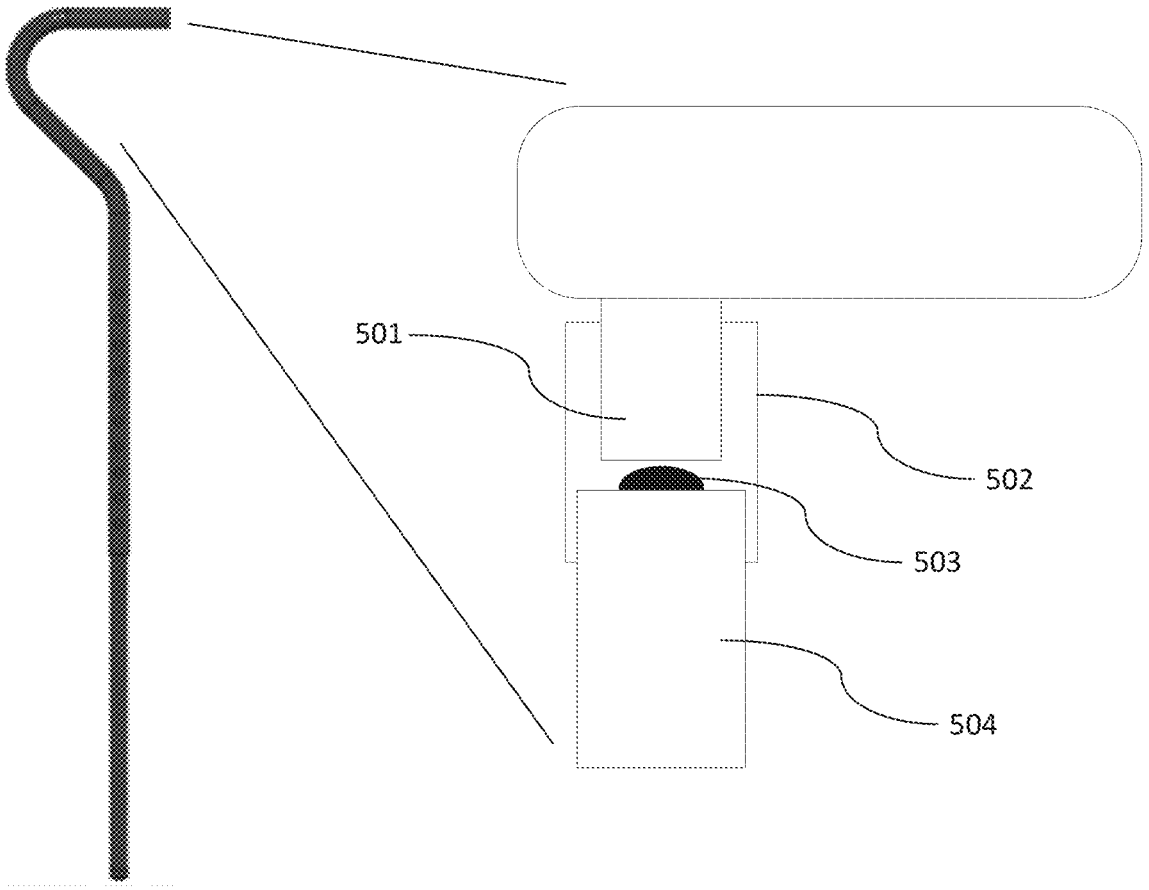
FIG. 5—A feedback device embodiment located in cane shaft, near handle, in accordance with an embodiment.

In at least one embodiment of the present disclosure, a feedback device may be configured as shown in FIG. 5. The feedback device can be a passive mechanical feedback device. Functioning similarly to the device of FIG. 1, the device of FIG. 5, when a predetermined desired force is input to the walking aid, the upper portion 501 of the walking aid bears upon a stack of snap domes 503, causing them to trip, and thus creating haptic feedback. The stack of snap domes is supported by the bottom portion 504 of the walking aid, and contained by a collar piece 502 which is fixed to either the upper portion 501 or lower portion 504 of the walking aid, and allows the portion the collar piece 502 is not fixed with to move within the collar piece 502 and thus allow the snap domes 503 to be tripped.

Figure 6:
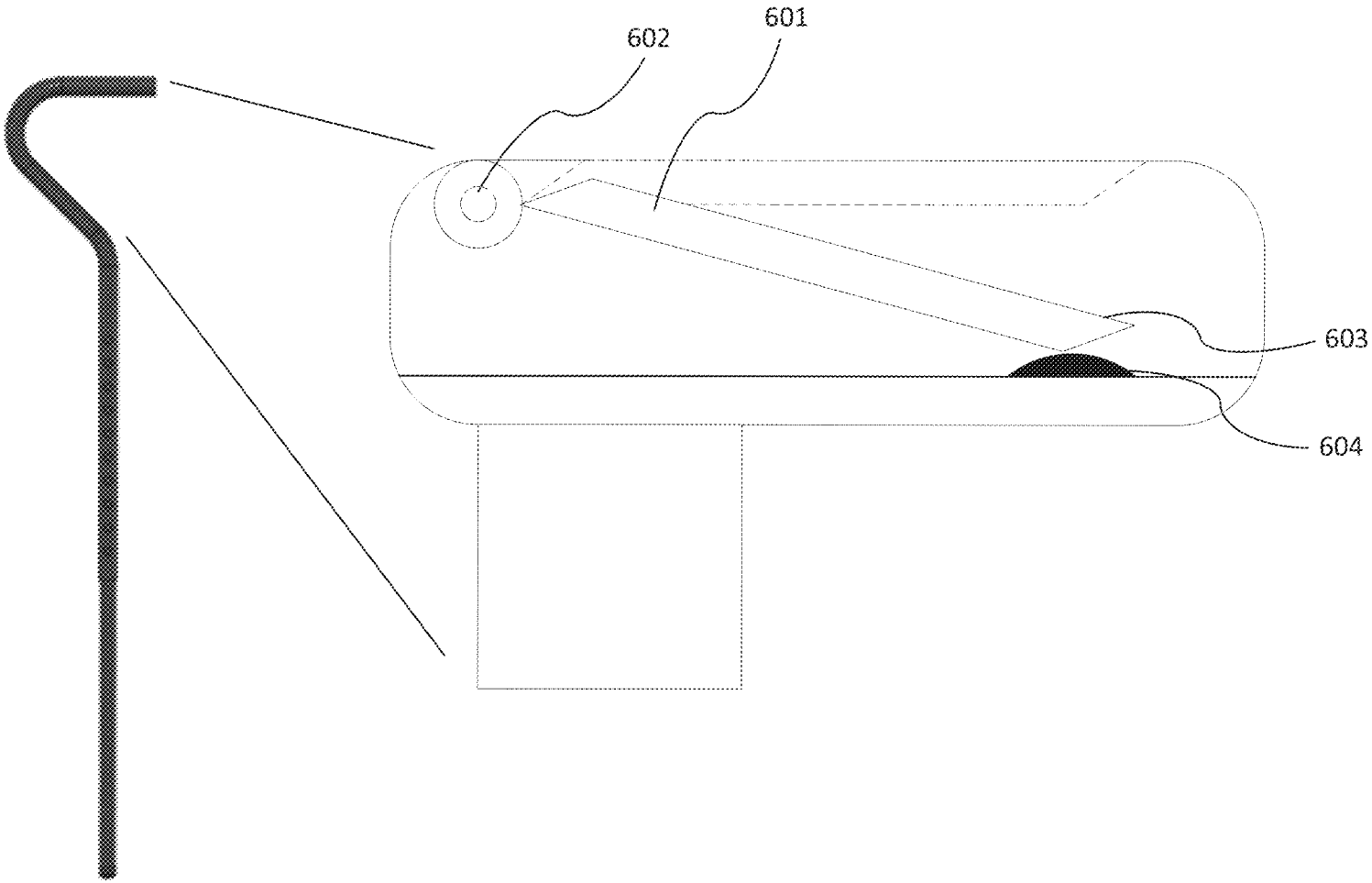
FIG. 6—A feedback device embodiment using a lever located in a cane handle, in accordance with an embodiment.

In another embodiment of the present disclosure, a feedback device may be configured as shown in FIG. 6. The device shown in FIG. 6 can be a passive mechanical feedback device. Components for providing haptic feedback are located in the handle of the walking aid. The top of the handle is moveable lever 601, fixed by a pin at one end 602, where the bottom of the lever 603 rests against a stack of snap domes 604, or some other tunable source of haptic feedback. When the lever on the handle is inputted with the predetermined desired force, the bottom of the lever trips the stack of snap domes causing a haptic feedback sensation.

In another embodiment of the present disclosure, a feedback device may be configured as shown in FIG. 7. The device shown in FIG. 7 can be a passive mechanical feedback device. Components for providing haptic feedback are located in the handle of the walking aid. The top of the handle is a panel 701, moveable compared to the rest of the walking aid, and supported from the walking aid by an assembly 702 including a stack of snap domes, snap bars, or some other tunable source of haptic feedback. When the panel 701 is inputted with the predetermined desired force, the panel 701 rests against the assembly 702 and causes the stack of snap domes to trip, causing a haptic feedback sensation.

Figure 8:
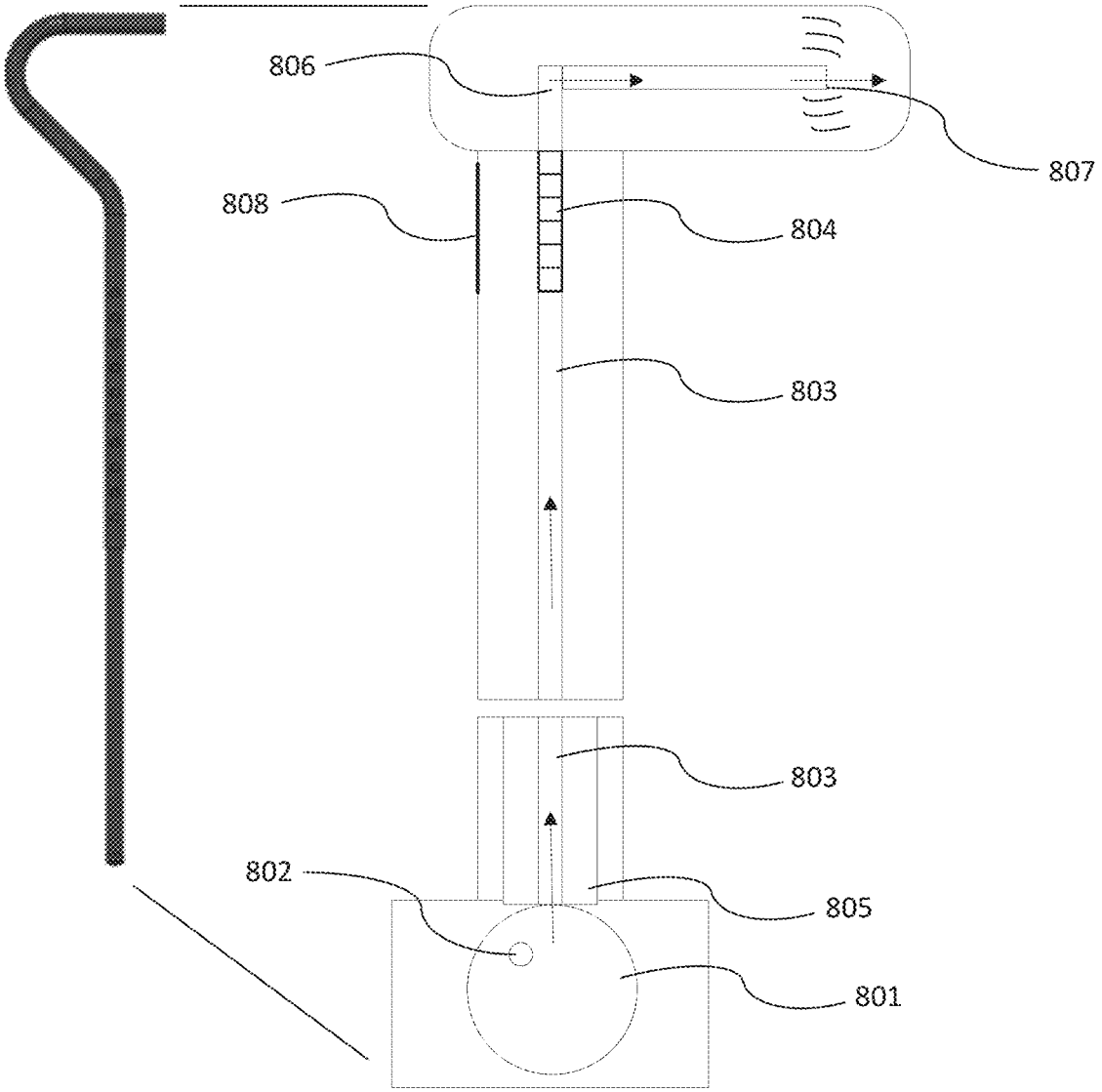
FIG. 8—A feedback device embodiment using pneumatic components, in accordance with an embodiment.

In another embodiment of the present disclosure, a passive feedback device may use pneumatic components to provide feedback in a walking aid. An example may be configured as shown in FIG. 8. Components for providing haptic feedback are located throughout the walking aid. A sac 801 is located near the foot of the walking aid. The sac 801, may be made of a rubber-like material, a composite material, a non-skid material, or other types of similar materials. A one way air inlet 802 allows air into the sac 801. The sac 801 is connected to a tube 803 or tube-like passage or structure running up the shaft of the walking aid, and connects to an adjustable relief valve 804. When force is inputted to and exerted upon the walking aid, the sac 801 deforms as it is compressed by the force between the walking aid and the walking surface, or the bottom of the walking aid 805 rests against the sac 801, and the sac 801 is contained within a separate walking aid foot, and the walking aid may move independently of the walking aid foot, bearing completely against the sac 801 before force is transferred through the walking aid foot to the walking surface. When compressed under force from the walking aid, the air pressure within the sac 801 increases. The adjustable relief valve 804 trips when the air pressure in the lower tube 803 reaches a pressure corresponding with a predetermined desired force. Tripping the adjustable relief valve 804 allows the passage of air through the relief valve 804 to the upper tube 806 continuing into the handle of the walking aid where air exits the walking aid via a vibrating air outlet 807 in the handle of the walking aid, thus causing a haptic feedback sensation. To adjust the predetermined desired force necessary to trip the relief valve 804, a panel 808 in the shaft of the walking aid may be removed to access the relief valve 804. Many relief valves, for example, could be adjusted by turning a screw to set the spring compression holding the relief valve closed, though other types of relief valves may be used as well.

Figure 9:
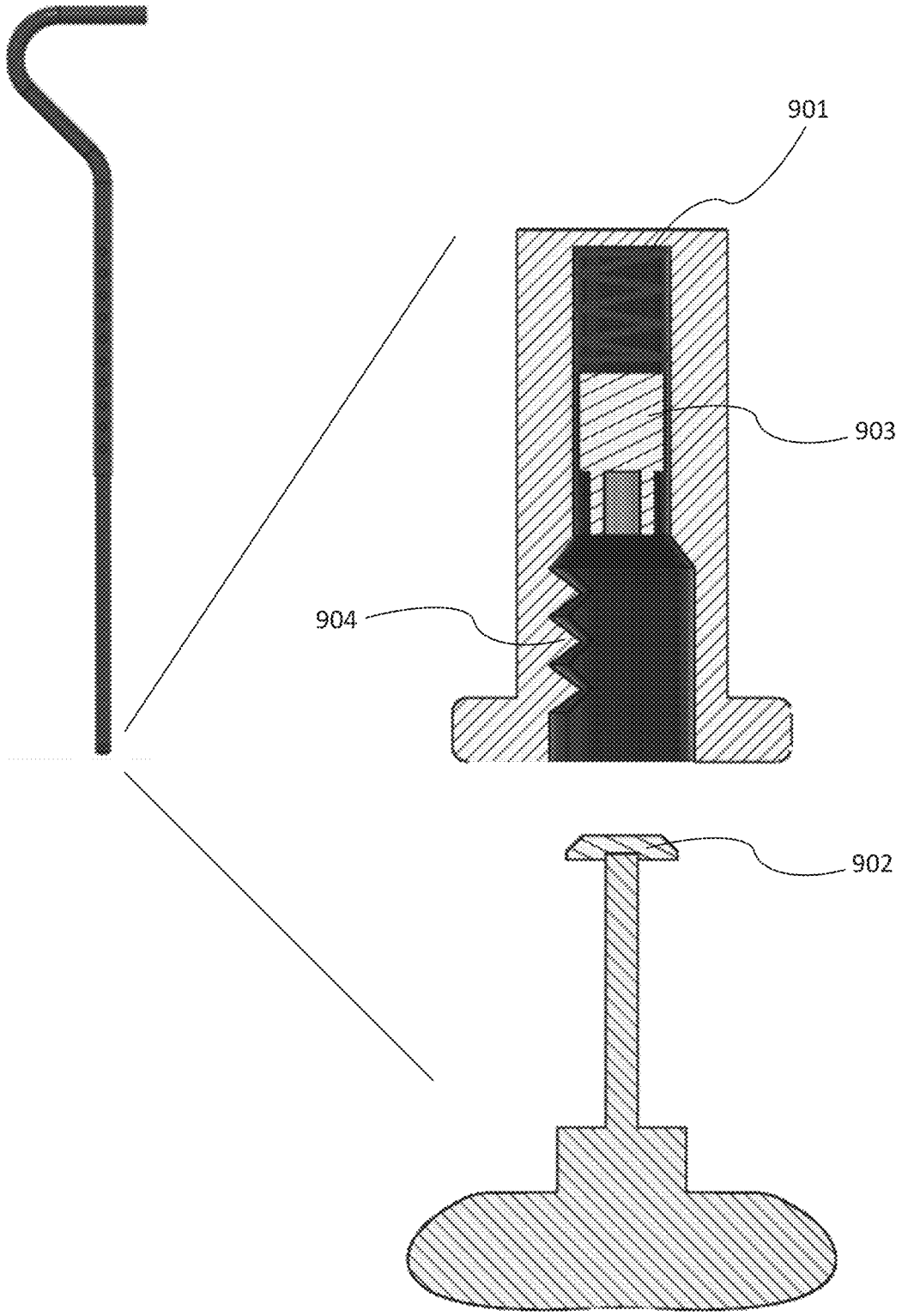
FIG. 9—A feedback device embodiment using a spring to set the load amount and providing a tactile response at load by an anvil travelling over ridges during spring compression.

In another embodiment of the present disclosure, a passive feedback device may be configured as shown in FIG. 9. Components for providing haptic feedback are located in the shaft, near the foot of the walking aid. The predetermined desired load is tuned by changing the spring compression, such as by shimming the spring 901, or swapping the spring 901 out for a spring with an appropriate spring constant. When the walking aid is inputted with the predetermined desired force, the spring 901 is compressed by the lever arm 902 bearing upon the block 903, allowing the lever arm 902 to travel over the ridges 904, thus causing a haptic feedback sensation. The block 903 and lever arm 902 sizing would prevent the spring from pushing the lever arm 902 completely out of the cavity where the ridges 904 are located.

Figure 10:
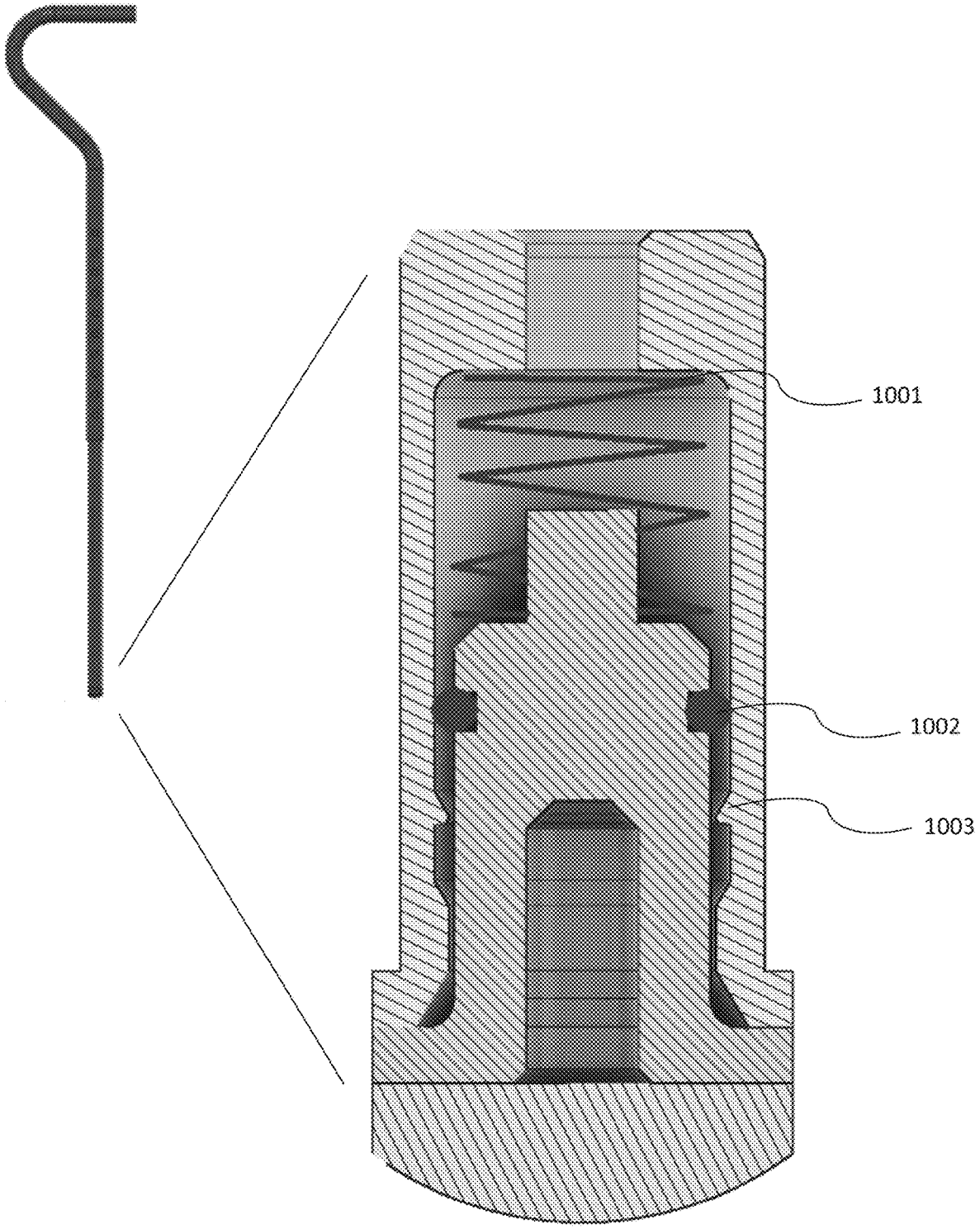
FIG. 10—A passive feedback device embodiment using a spring to set the load amount and providing a tactile response at load by snapping an o-ring over a groove during spring compression.

In at least one embodiment of the present disclosure, a passive feedback device may be configured as shown in FIG. 10. As in other figures shown herein, FIG. 10 may not be to scale in order to better illustrate notable aspects of the embodiment. Components for providing haptic feedback are located in the shaft of the walking aid. The predetermined desired force is tuned by changing the spring compression, such as by shimming the spring 1001, or swapping the spring 1001 out for a spring with an appropriate spring constant. When the walking aid is inputted with the predetermined desired force, the spring 1001 is compressed and the o-ring 1002 is rolled over a groove 1003, thus causing a "popping" haptic feedback sensation.

Figure 11:
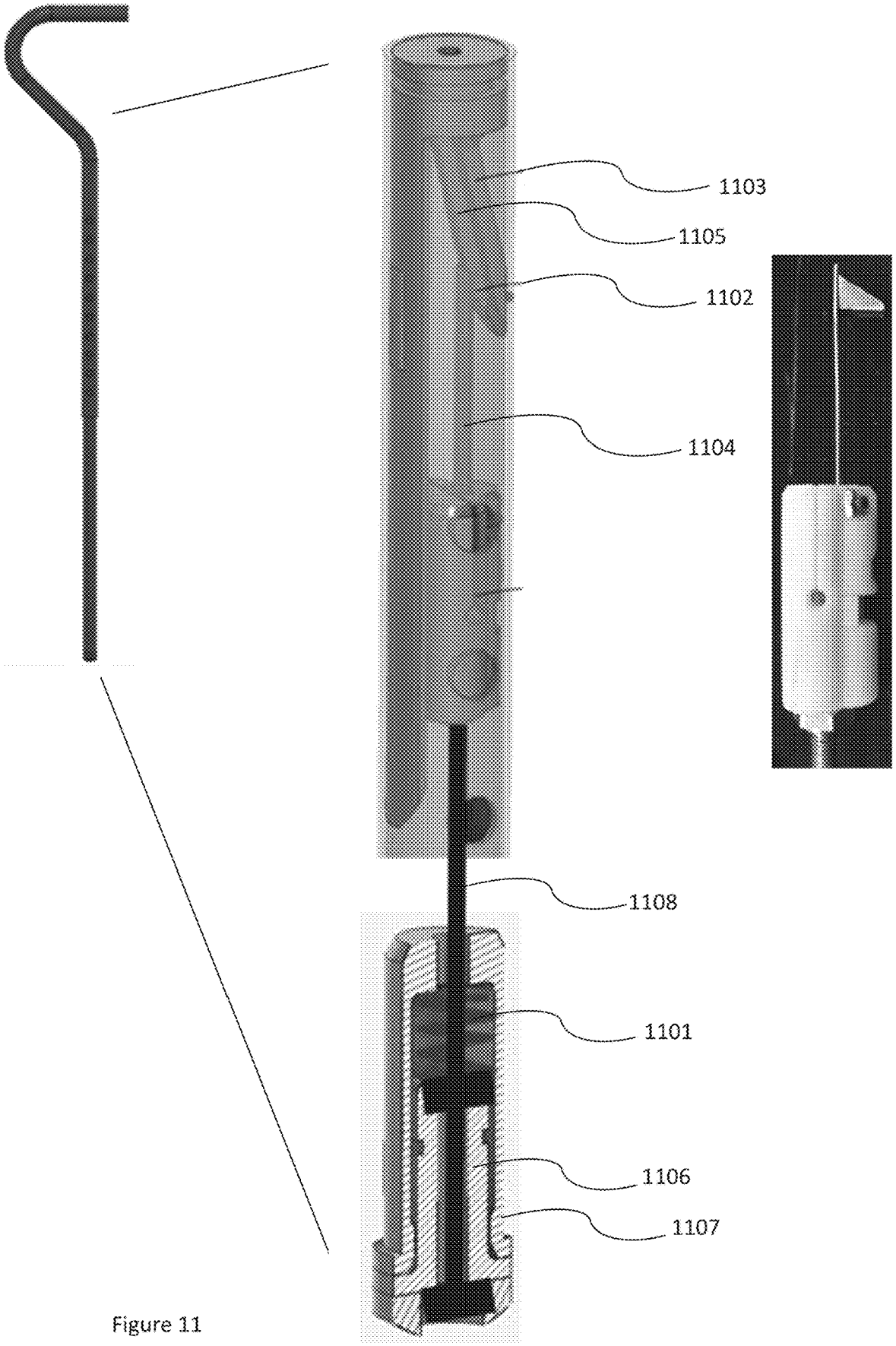
FIG. 11—A passive feedback device embodiment using a spring to set the load amount and providing a tactile response at load by striking the body of the cane with a hammer during spring compression.

In at least one embodiment of the present disclosure, a passive feedback device may be configured as shown in FIG. 11. Components for providing haptic feedback are located in the shaft of the walking aid. The predetermined desired force is tuned by swapping the spring out for a spring 1101 with an appropriate spring constant, or adjusting the length of the rod 1108 connecting the hammer components (1102, 1103, 1104, 1105) to the force input components (1101, 1106, 1107). When the walking aid is inputted with the predetermined desired force, the spring 1101 is compressed and the hammer 1102 travels up the ramp 1103, loading the leaf spring 1104 which the head of the hammer 1102 is fixed, to a cutout in the ramp 1103 where the head of the hammer 1102 falls off the ramp 1103 and strikes the shaft of the walking aid, thus causing a haptic feedback sensation. As the force is removed from the walking aid the hammer 1102 travels back toward the bottom of the ramp 1103. As the hammer 1102 travels to the bottom of the ramp, the ramp, which is comprised of two pieces 1103 1105, is spread apart as the hammer 1102 pushes on the pieces as it returns to a starting position at the bottom of the ramp 1103. Because the two ramp pieces 1103 1105 act as leaf springs when the hammer separates them, the two pieces 1103 1105 return together between the hammer 1102 and the walking aid shaft once the hammer 1102 has returned to its no load position.

Also shown in FIG. 11 is an alternative to the footpiece retaining components shown in FIG. 1 (indent 103 and tab 104). In some embodiments, an inner piece 1106 may be retained within an outer piece 1107 by using an o-ring. As shown in FIG. 11, the inner piece 1106 has a groove to seat an o-ring on its outer surface, and the outer piece's 1107 wall thickness increases near its opening, reducing the diameter at the opening of the outer piece 1107 and causing the o-ring to hold the inner piece 1106 within the outer piece 1107 when the walking aid is not under any force or constraint. The inner piece 1106 may be removed from the outer piece 1107 by pulling with enough force to overcome the interference of the o-ring with the outer piece 1107.

Also, as shown in FIG. 11, other embodiments disclosed herein may be configured to decouple the portion providing feedback from the portion which is tuned for receiving a predetermined desired force, as the rod 1108 does. For example, the feedback mechanisms shown in FIGS. 9 and 10 may also be separated from portions of those embodiments which are tuned for receiving the predetermined desired force.

Figure 12:
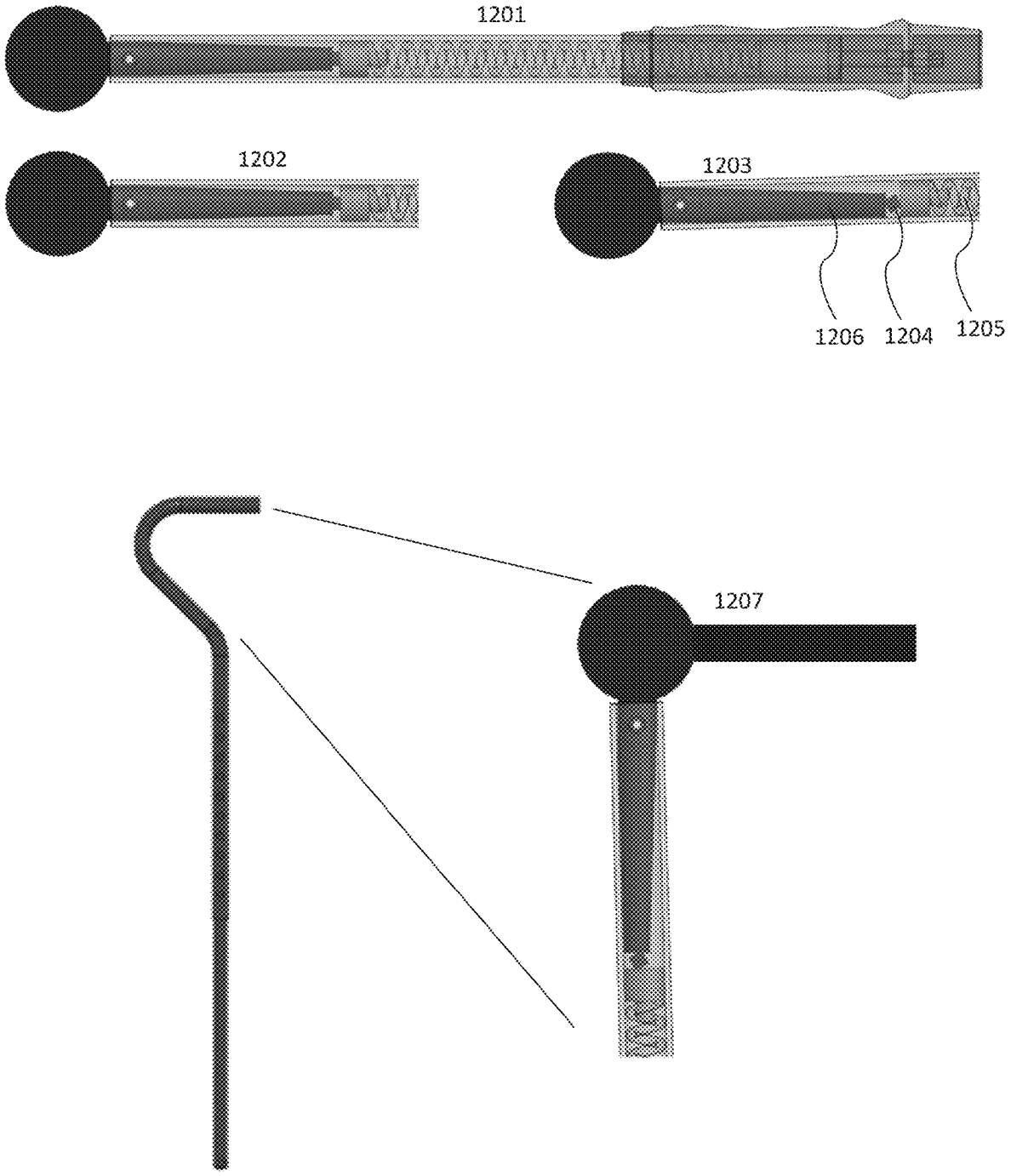
FIG. 12—A passive feedback device embodiment with a tactile feedback mechanism as used in a torque wrench, in accordance with an embodiment.

In at least one embodiment of the present disclosure, a passive feedback device may be configured as shown in FIG. 12. The feedback device provides an audible snapping and haptic feedback via a torque force mechanism. For example, the mechanism in FIG. 12 shows a clicker-type torque wrench mechanism before 1202 and after 1203 the predetermined desired force is applied. When the mechanism trips 1203, the block 1204 between the spring 1205 and the head stock 1206 of the wrench rolls, allowing the head stock 1206 to contact the wrench shaft. By implementing such a mechanism, either permanent or removable, to the handle or upper shaft of a walking aid 1207, the user of the walking aid receives feedback from the mechanism when the user applies the predetermined desired force to the handle of the walking aid.

Several embodiments of the present disclosure may be used to provide a user of a walking aid feedback about when the user is loading the walking aid properly. Proper or desired walking aid loading is a specification set for a walking aid user per a recommendation from some source of knowledge and authority on the topic of proper walking aid loading, like a doctor or physiotherapist. In the several embodiments of the present disclosure used to provide feedback to the user of a walking aid, the "predetermined desired force" is both the trip force the device is tuned to, and a specified force that a doctor or physiotherapist may prescribe, recommend, encourage, etc. the user of the walking aid to exert into the walking aid. For example, proper cane loading may be specified by a doctor or physiotherapist as a percentage of the user's body weight being supported by the cane, or Body Weight Support (BWS). While an individual is rehabilitating an injury to one leg, a doctor may specify for a given time period the individual should be applying 50% body weight to the injured leg, leaving 50% body weight to be supported by some form of walking aid. If the walking aid used is a cane, the feedback device is configured to be coupled, attached, or installed to the cane, and to generate a signal to the individual, or feedback, when the feedback device and cane is subject to an axial load input by the cane user of 50% of the cane user's body weight. To further illustrate the example with one of the passive feedback device embodiments of the present disclosure: using snap domes, a series of snap domes with trip forces totaling 50% of the individual's body weight are loaded into the feedback device. This calculation and adjustment of the trip force in the feedback device may also be referred to as tuning the feedback device, or tuning the mechanism, to the predetermined desired force.

Overloading may occur when the user of a walking aid is applying too much force to a walking aid. Continually overloading the walking aid puts the user at risk of developing an injury from misusing the walking aid. Overloading in the walking aid can lead to unwanted musculoskeletal loading, asymmetrical gait, or other detrimental walking patterns. For example, an individual may have a target BWS of 15% by using a cane in the hand opposite a knee joint suffering from osteoarthritis. If the individual begins to overcompensate for the osteoarthritis pain in the knee, and begins to repeatedly load the cane to 30% or more BWS, the risk of causing a secondary injury in the arm, back, or elsewhere in the individual's body increases.

Some embodiments of the passive or active device may be used to provide additional feedback to the user about when a walking aid is subjected to overloading by the user. An upper threshold for loading the walking aid may be established by a source of knowledge and authority on walking aid loading, like a doctor or physiotherapist. The device is then configured to provide a first feedback signal to the user when the walking aid has reached the target BWS load, and then a second feedback signal to the user when the walking aid has reached or exceeded the upper threshold BWS load. The second signal is provided to the user in a manner similar to the first. For example, with one of the passive feedback device configurations of the present disclosure, the first feedback signal is a tripping of a series of snap domes configured to "snap" when the walking aid axial load reaches a predetermined, desired load. A second feedback signal at the upper threshold for loading is generated by having a second series of snap domes engaged by the device after the first series, with the cumulative force total of both snap dome series' being equal to the desired upper threshold of walking aid loading where the user can benefit from knowing when the walking aid is being overloaded. For a further example, with an active feedback device described in the present disclosure, the feedback signals for the predetermined desired force and the predetermined excessive force are generated the same way, though the device's program may be tuned to provide the feedback when the load sensor reaches either of the input forces. To make the feedback from the predetermined desired force and the feedback from the predetermined excessive force more easily discernable to the user, a different delivery of the feedback may be used. For example, the feedback for the predetermined desired force may be a short signal, and the feedback for the predetermined excessive force may be a longer signal. In another example, the feedback for the predetermined desired force may be haptic feedback, and the feedback for the predetermined excessive force may be audio feedback.

Figure 13:
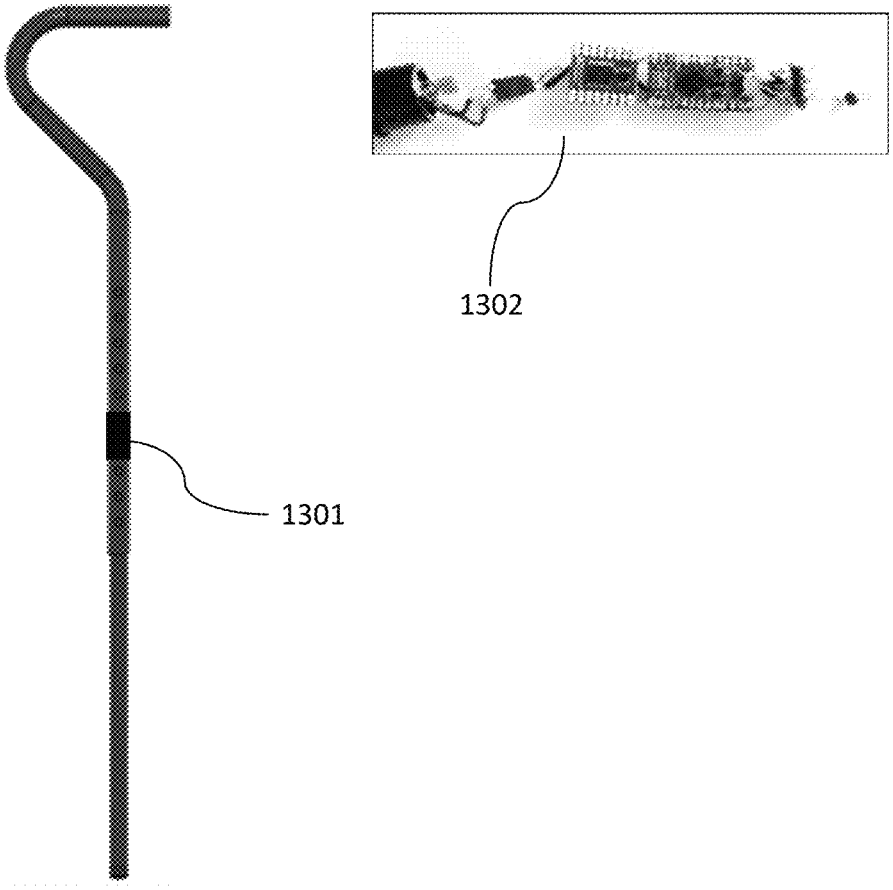
FIG. 13—An active feedback device in a cane, in accordance with an embodiment.

In some embodiments of the present disclosure, an active device with electronic components is used to measure axial loading in the walking aid, program predetermined, desired axial loading thresholds, provide feedback to user when predetermined axial loading thresholds are measured, and record a history of axial loading over time. FIG. 13 shows a configuration of an active device. Components in an active device may include a load sensor 1301, a power source, a vibrational motor (or linear resonant motor, or non-contact haptic display, or device creating haptic feedback, etc.) 1302, a real-time clock, a data logger, and a microcontroller 1302. The load sensor may be further made up of a force sensor, and a signal amplifier. The force sensor measures the axial force applied to the walking aid, and outputs a signal to the amplifier and the amplified signal is then sent to the microcontroller. The microcontroller is programmed to activate the vibrational motor if the force sensed within the walking aid has reached the predetermined desired force in terms of user body weight support. The data logger and real-time clock may be used to track the user's activity with the walking aid for further analysis by a source of knowledge on the subject of gait training with a walking aid, like a doctor or physiotherapist. For example, the data logger may gather loading cycle information over time for a physiotherapist's reference while helping the walking aid's user become accustomed to a proper walking aid-assisted gait. The vibrational motor may also be replaced or combined with a component to provide either an audible signal or a visible signal, or both.

Some embodiments of a passive or active feedback device may be used to provide encouragement to use the walking aid. Some embodiments of the passive or active feedback device may be used to provide encouragement to do more walking, generally. Some embodiments of an active device could be used to track information about use, including but not limited to, walking aid loading information, percent utilization (number of steps taken in a day with the walking aid divided by the number of steps taken in a day total multiplied by 100) in conjunction with a step counter or another source of tracking a walking aid user's total steps in a day, time of use, and frequency of use. This data may then be used further by a physiotherapist or doctor to provide additional helpful feedback to a user.

We claim:

1. A device for providing feedback when inputted with a specified axial load, the device comprising:

a feedback mechanism configured to be removably coupled to a walking aid, wherein the feedback mechanism comprises at least one snap dome, wherein the walking aid is configured to be held by a user when in use to thereby support a weight of the user, wherein the feedback mechanism provides discrete feedback when inputted with the specified axial load, wherein the feedback mechanism is tunable to the specified axial load, and wherein the discrete feedback comprises a haptic signal and an audible signal.

2. The device of claim 1, wherein the device provides feedback passively, through no use of electronic components.

3. The device of claim 1, wherein the specified axial load is generated by an external force.

4. The device of claim 1, wherein the device is affixed to the walking aid and both the device and the walking aid bear the specified axial load.

5. A system for providing feedback to a user, the system comprising:

a walking aid configured to receive an axial force applied to the walking aid by the user, wherein the walking aid is configured to be held by the user when in use to thereby support a weight of the user;

a device, removably attached to the walking aid, wherein the device is subjected to the same axial force as the walking aid; and the device generates a feedback signal about the axial force to the user, wherein feedback about the axial force provides the user feedback when the device is subjected to a predetermined desired force, wherein the feedback signal comprises a haptic signal and an audible signal, and wherein generating the feedback signal comprises applying the axial force input by the user to a series of snap domes comprising at least one snap dome positioned in the walking aid, wherein when the axial force exceeds a designed threshold force of the at least one snap dome, the at least one snap dome trips, thereby causing the feedback signal to the user of the walking aid.

6. The system of claim 5, wherein providing positive feedback to the user when the device is subjected to the predetermined desired force comprising at least the steps of:

when the device is supporting the predetermined desired force, the device trips; and tripping the device generates the feedback signal.

7. The system of claim 5, wherein the walking aid comprises one of:

a cane;

a walker;

a single crutch;

a pair of crutches;

a single forearm crutch; and a pair of forearm crutches.

8. The system of claim 5, wherein the device:

is located in the walking aid on or near the end of the walking aid engaging with the walking surface; and is further configured to receive walking aid attachments providing better support on walking surfaces of varying conditions.

9. The system of claim 5, wherein axial displacement occurring in the walking aid when the device provides feedback to the user is less than 25 mm.

10. The system of claim 5, wherein one or more of the at least one snap dome is replaced with a blank disk of the same thickness to reduce the predetermined desired force and maintain the height of the series of snap domes.

11. The system of claim 5, wherein tuning the predetermined desired force at which the device provides feedback to the user comprises:

stacking the series of snap domes including the at least one snap dome, each of the series of snap domes having an individual trip force, wherein the sum of each of the individual trip forces is the total trip force for the series of snap domes;

adding an appropriate assortment of snap domes to set the total trip force for the series equal to the predetermined desired force; and placing the series of snap domes in the device.

12. A method of providing positive feedback for proper walking aid-assisted gait, the method comprising:

tuning a feedback device to provide a first feedback when inputted with a predetermined desired force;

removably attaching the feedback device to a walking aid;

supporting a user's weight by inputting a force into the walking aid, which is thereby inputted to the feedback device attached to the walking aid, wherein the walking aid is configured to be held by the user when in use to thereby support the user's weight; and providing the first feedback to the user when the force inputted into the walking aid reaches the predetermined desired force, wherein the first feedback comprises a haptic signal and an audible signal, and wherein providing the first feedback comprises applying the force input by the user to a series of snap domes comprising at least one snap dome positioned in the walking aid, wherein when the axial force exceeds a designed elastic deformation force of the at least one snap dome, the at least one snap dome trips, thereby causing the first feedback signal to the user of the walking aid.

13. The method of claim 12, further comprising:

tuning the feedback device to provide a second feedback when inputted with a predetermined excessive force, wherein the predetermined excessive force is greater than the predetermined desired force; and providing the second feedback to the user when the force inputted into the walking aid reaches the predetermined excessive force.

* * * * *